US007638944B2

(12) United States Patent
Song

(10) Patent No.: US 7,638,944 B2
(45) Date of Patent: Dec. 29, 2009

(54) ADDRESS ELECTRODE STRUCTURE FOR PLASMA DISPLAY PANEL

(75) Inventor: Jung-Suk Song, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 463 days.

(21) Appl. No.: 11/251,781

(22) Filed: Oct. 18, 2005

(65) Prior Publication Data

US 2006/0082302 A1 Apr. 20, 2006

(30) Foreign Application Priority Data

Oct. 19, 2004 (KR) ..... 10-2004-0083504

(51) Int. Cl.
*H01J 17/49* (2006.01)

(52) U.S. Cl. ..... 313/584; 313/582; 313/585

(58) Field of Classification Search ..... 313/582–587; 315/169.1, 169.4; 345/37, 41, 60, 71
See application file for complete search history.

(56) References Cited

U.S. PATENT DOCUMENTS

| | | | | |
|---|---|---|---|---|
| 6,229,261 | B1 * | 5/2001 | Kim | 313/586 |
| 7,009,587 | B2 * | 3/2006 | Nishimura et al. | 345/67 |
| 2004/0032215 | A1 * | 2/2004 | Nishimura et al. | 315/169.3 |
| 2004/0113556 | A1 * | 6/2004 | Huang et al. | 313/586 |
| 2004/0212303 | A1 * | 10/2004 | Kao et al. | 313/582 |
| 2005/0046353 | A1 * | 3/2005 | Kwon et al. | 313/586 |
| 2005/0122045 | A1 * | 6/2005 | Sung et al. | 313/582 |

FOREIGN PATENT DOCUMENTS

| | | |
|---|---|---|
| JP | 10-188819 | 7/1998 |
| JP | 2001-126629 | 5/2001 |
| JP | 2002-231143 | 8/2002 |
| JP | 2003-031138 | 1/2003 |
| JP | 2003-068210 | 3/2003 |
| JP | 2003-288845 | 10/2003 |
| KR | 2003-0013036 | 2/2003 |

* cited by examiner

*Primary Examiner*—Joseph L Williams
*Assistant Examiner*—Fatima N Farokhrooz
(74) *Attorney, Agent, or Firm*—H.C. Park & Associates, PLC

(57) ABSTRACT

A plasma display panel including a first substrate and a second substrate arranged substantially in parallel with each other, barrier ribs arranged between the first and second substrates to define discharge cells, and a phosphor layer arranged in the discharge cells. First discharge electrodes are arranged in the discharge cells, and second discharge electrodes are arranged in the discharge cells and in a direction crossing the first discharge electrodes to generate an address discharge with the first discharge electrodes. The second discharge electrodes include windows having different sizes for discharge cells having different color phosphor layers.

9 Claims, 3 Drawing Sheets

ADDRESS ELECTRODE STRUCTURE FOR PLASMA DISPLAY PANEL

CROSS REFERENCE TO RELATED APPLICATION

This application claims priority to and the benefit of Korean Patent Application No. 10-2004-0083504, filed on Oct. 19, 2004, which is hereby incorporated by reference for all purposes as if fully set forth herein.

BACKGROUND OF THE INVENTION

1. Field of the Invention

The present invention relates to a plasma display panel (PDP), and more particularly, to a PDP with electrodes that may compensate for the different discharge characteristics of discharge cells coated with red, green, and blue phosphor layers.

2. Discussion of the Background

Generally, plasma display panels (PDPs) are flat panel display devices with a discharge gas in a space enclosed between facing substrates. A plurality of discharge electrodes are arranged on the substrates to generate discharges in the space, thereby generating ultraviolet (UV) rays. The UV rays excite a phosphor layer to emit light that forms visible images.

FIG. 1 is an enlarged view showing discharge electrodes included in a PDP 100 as disclosed in Korean Laid Open Patent Application No. 2003-13036, and FIG. 2 is a cross-sectional view showing the PDP 100.

Referring to FIG. 1 and FIG. 2, stripe shaped barrier ribs 120 partition a discharge space of the PDP 100. The PDP 100 includes an address electrode 140 and a pair of transparent electrodes in each discharge cell to independently control light emitted from the discharge cells. The transparent electrode pair includes a display electrode 160 and a scanning electrode 180.

A plurality of stripe shaped address electrodes 140 are arranged along an X-axis direction on a lower substrate 210, and a dielectric layer 220 is formed on the lower substrate 210 to cover the address electrodes 140. A plurality of barrier ribs 120 are arranged on the dielectric layer 220 and between the address electrodes 140, thereby partitioning the discharge space to correspond to each of the address electrodes 140. Red, green, and blue phosphor layers are coated on the barrier ribs 120.

The address electrodes 140 include non-conductive regions 140*a* where the address electrodes 140 face the display electrodes 160. The non-conductive regions 140*a* have no address electrode material, are arranged entirely within the address electrodes 140, and are arranged to correspond to each of the display electrodes 160.

An operation for selectively discharging a certain display cell in the PDP 100 is described below.

First, when an address voltage is applied across the address electrodes 140 and the scanning electrodes 180, plasma occurs in the discharge space, and electrons and ions of the plasma migrate towards an electrode having an opposite polarity. Therefore, negative charges accumulate on the surface of the dielectric layer 220 covering the address electrodes 140, and positive charges accumulate on the surface of a transparent dielectric layer 230 covering the scanning electrodes 180.

Since the address electrodes 140 have reduced areas where they face the display electrodes 160, charges generated during address periods concentrate on the transparent dielectric layer 230 corresponding to the scanning electrodes 180 and on a region of the dielectric layer 220 where the address electrodes 140 face the scanning electrodes 180. However, substantially no charges accumulate on the dielectric layer 220 above the non-conductive regions 140*a*.

As such, the non-conductive regions 140*a* prevent charges from accumulating on the dielectric layer 220 facing the display electrodes 160, prevent the charges accumulated on the dielectric layer 220 from traveling towards the display electrodes 160, and prevent wall charges from forming on the transparent dielectric layer 230 facing the display electrodes 160.

Thus, when selectively discharging the display cells by applying a discharge sustain voltage across the scanning electrodes 160 and the display electrodes 180 during sustaining periods, if the wall charges are not accumulated towards the display electrodes 160 as described above, an error between wall charges predicted during designing and actual wall charges generated by address discharge may be minimized.

Therefore, the PDP 100 may minimize the possibility of erroneous discharge while accurately sustain discharging only those display cells that were selected during the address period.

Although the conventional PDP 100 may prevent erroneous discharges to some extent by including address electrodes on which windows are formed, a PDP that compensates for the different discharge characteristics of discharge cells coated with red, green, and blue color phosphor layers and minimizes electric field interference between neighboring address electrodes 140 disposed in adjacent discharge cells is needed.

SUMMARY OF THE INVENTION

The present invention provides a PDP with an improved electrode structure that may lower an address current when applying the same voltage to the PDP, prevent erroneous discharge, and compensate for different discharge characteristics of the red, green, and blue discharge cells.

The present invention also provides a PDP with an improved electrode structure that may minimize electric filed interference between neighboring address electrodes.

Additional features of the invention will be set forth in the description which follows, and in part will be apparent from the description, or may be learned by practice of the invention.

The present invention discloses a PDP including a first substrate, a second substrate arranged substantially parallel to the first substrate, barrier ribs arranged between the first and second substrates and defining discharge cells, a phosphor layer arranged in the discharge cells, first discharge electrodes arranged in the discharge cells, and second discharge electrodes arranged in the discharge cells and in a direction crossing the first discharge electrodes to generate an address discharge with the first discharge electrodes. The second discharge electrodes comprise windows having different sizes for discharge cells having different color phosphor layers.

The present invention also discloses a PDP including a first substrate, a second substrate arranged substantially parallel to the first substrate, barrier ribs arranged between the first and second substrates and defining discharge cells, a phosphor layer arranged in the discharge cells, first discharge electrodes arranged in the discharge cells, and second discharge electrodes arranged in a direction crossing the first discharge electrodes to generate an address discharge with the first discharge electrodes. The second discharge electrodes comprise windows that are nonlinearly arranged along different color discharge cells.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
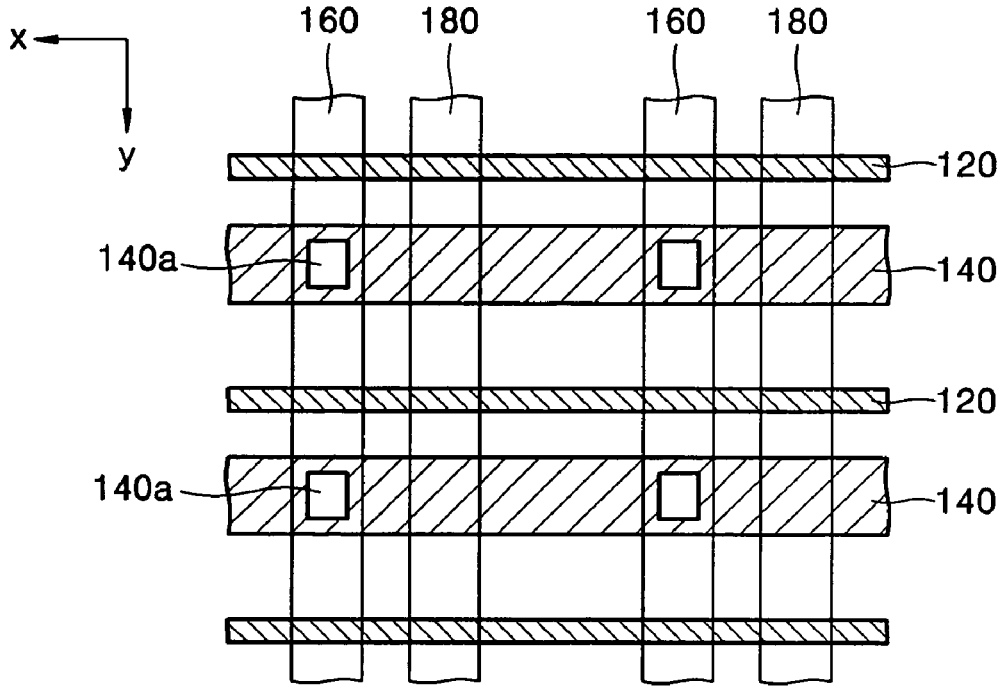
FIG. 1 (PRIOR ART)
FIG. 1 is an enlarged view showing conventional discharge electrodes.
Figure 2:
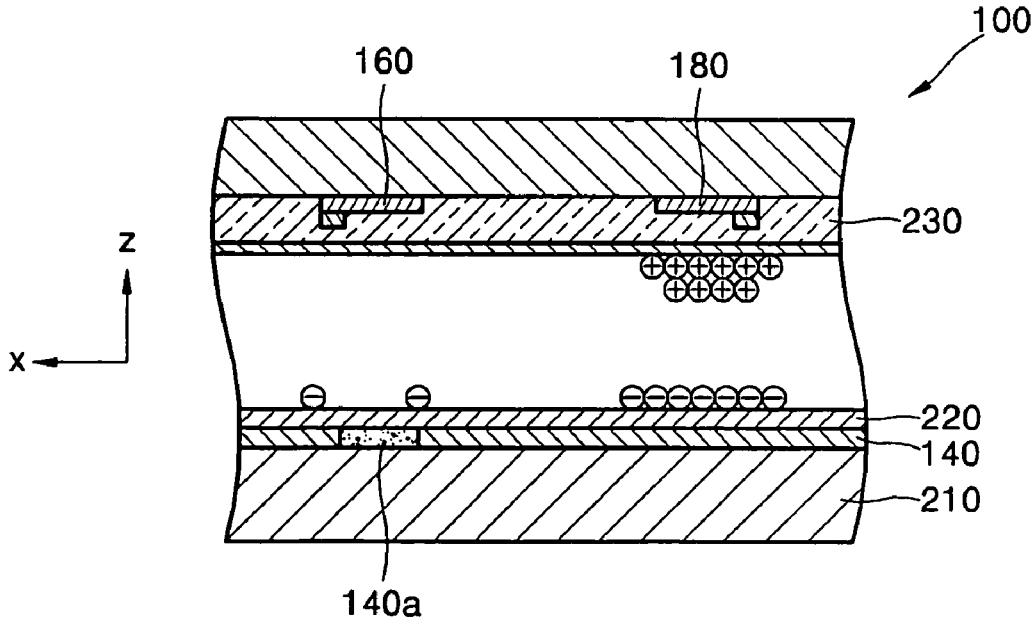
FIG. 2 (PRIOR ART)
FIG. 2 is a cross-sectional view showing a PDP including the discharge electrodes of FIG. 1.

The present invention will now be described more fully with reference to the accompanying drawings, in which exemplary embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

It will be understood that when an element such as a layer, film, region or substrate is referred to as being "on" another element, it can be directly on the other element or intervening elements may also be present. In contrast, when an element is referred to as being "directly on" another element, there are no intervening elements present.

Figure 3:
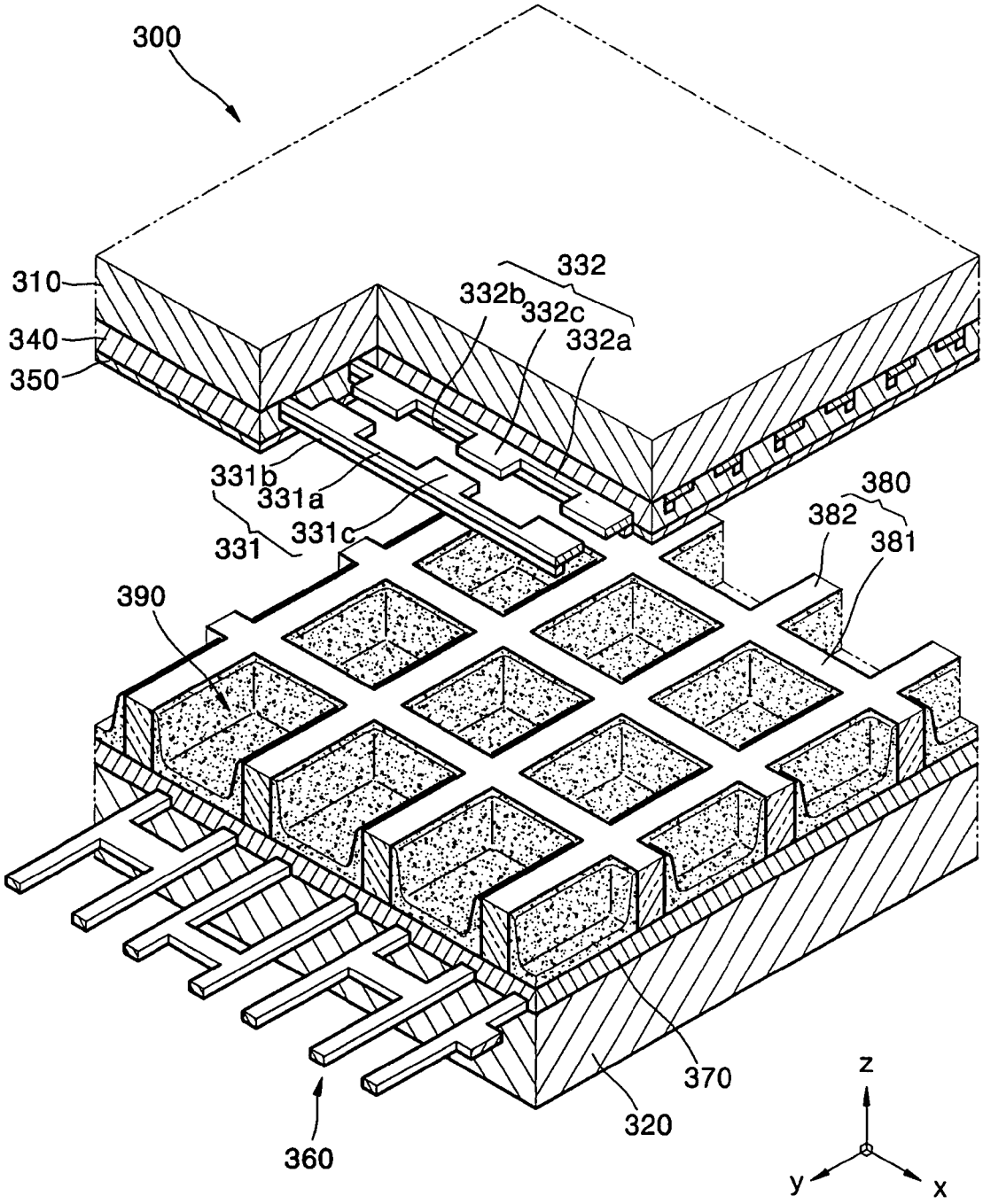
FIG. 3 is an exploded perspective view of a proton of a PDP according to a first exemplary embodiment of the present invention.

FIG. 3 is an exploded perspective view showing a portion of a PDP 300 according to a first exemplary embodiment of the present invention.

Referring to FIG. 3, the PDP 300 includes a front substrate 310 and a rear substrate 320 arranged substantially in parallel with each other. The front and rear substrates 310 and 320 are coupled together with a frit glass coated along the edges of inner surfaces of the substrates, thereby forming a sealed discharge space between them.

The front substrate 310 may be made of a transparent material such as soda lime glass. Pairs of discharge sustaining electrodes are arranged along the X direction of the PDP 300.

A discharge sustaining electrode pair includes an X electrode 331 and a Y electrode 332. The X and Y electrodes 331, 332 are alternately arranged along the Y direction of the PDP 300 at predetermined intervals. The X electrode 331 includes a first transparent electrode line 331*a* arranged on an inner surface of the front substrate 310, and a first bus electrode line 331*b* arranged along an edge of the first transparent electrode line 331*a*. The Y electrode 332 includes a second transparent electrode line 332*a* and a second bus electrode line 332*b* arranged along an edge of the second transparent electrode line 332*a*.

Also, a pair of the first and second transparent electrode lines 331*a* and 332*a* are arranged in a single discharge cell, and first and second protrusions 331*c* and 332*c* protrude from inner walls of the first and second transparent electrode lines 331*a* and 332*a*, respectively, into the discharge cell so that they face each other in the discharge cell. A discharge gap exists between the first and second protrusions 331*c* and 332*c*, and the first and second protrusions 331*c* and 332*c* may be formed as a single body with the first and second transparent electrode lines 331*a* and 332*b*, respectively.

As a result, each of the X electrode 331 and the Y electrode 332 are formed with a plurality of prominences and depressions extending from a side wall of the first and second transparent electrode lines and disposed in a direction x of the discharge cell.

The first and second transparent electrode lines 331*a* and 332*a* and the first and second protrusions 331*c* and 332*c* are made of a transparent conductive material, such as indium tin oxide (ITO), so that light may transmit through them. The first and second bus electrode lines 331*b* and 332*b* are made of highly conductive metallic materials such as, for example, Ag paste or Cr—Cu—Cr alloy to reduce the line resistance of the first and second transparent electrode lines 331*a* and 332*a* and improve electric conductivity.

A space between a pair of the X and Y electrodes 331 and 332 and an adjacent pair of X and Y electrodes 331 and 332 is a non-discharge region. A black stripe layer may be arranged in the non-discharge region to improve contrast.

A front dielectric layer 340 covers the X and Y electrodes 331 and 332. The front dielectric layer 340 may be made by adding various fillers to a glass paste. The front dielectric layer 340 may be selectively formed where the X and Y electrodes 331 and 332 are formed, or it may cover the bottom surface of the front substrate 310.

A protective layer 350, such as a magnesium oxide (MgO) layer, covers the front dielectric layer 340 to prevent damage to the front dielectric layer 340 and increase secondary electron emission.

Address electrodes 360 are arranged on the rear substrate 320 and are covered by a rear dielectric layer 370. The address electrodes 360 are arranged in a direction crossing the pairs of discharge sustaining electrodes.

Barrier ribs 380 are arranged between the front and rear substrates 310 and 320 to define the discharge cells together with the front and rear substrates 310 and 320. The barrier ribs 380 include first barrier ribs 381, which are arranged along the X direction of the PDP 300, and second barrier ribs 382, which are arranged along the Y direction of the PDP 300. The first barrier ribs 381 extend as a single body in a direction opposite to an inner wall of a pair of adjacent second barrier ribs 382, thereby forming a matrix.

The barrier ribs may be formed in various configurations. For example, the barrier ribs may be a meander type, delta type, honeycomb type, etc., or they may be stripe-shaped extending along the same direction as the address electrodes 360. Further, the discharge cells partitioned by the barrier ribs may have numerous structures in addition to that shown in FIG. 3. For example, the discharge cells may have other polygonal shapes or a circular shape.

A discharge gas, such as Ne—Xe or He—Xe, is injected into the discharge cells.

Additionally, red, green, and blue phosphor layers 390 are arranged in the discharge cells. The red, green, and blue phosphor layers 390 may be coated on any region of the discharge cells, but in the present embodiment, they are coated on sides of the barrier ribs 380. For example, the red phosphor layer may be made of (Y, Gd) $BO_3$:$Eu^{+3}$, the green phosphor layer may be made of $Zn_2SiO_4:Mn^{2+}$, and the blue phosphor layer may be made of $BaMgAl_{10}O_{17}:Eu^{2+}$.

Here, the address electrodes 360 have different sized windows 364 (see FIG. 4) inside the red, green, and blue discharge cells, and portions where the window 364 is formed are arranged on different lines from one another.

Figure 4:
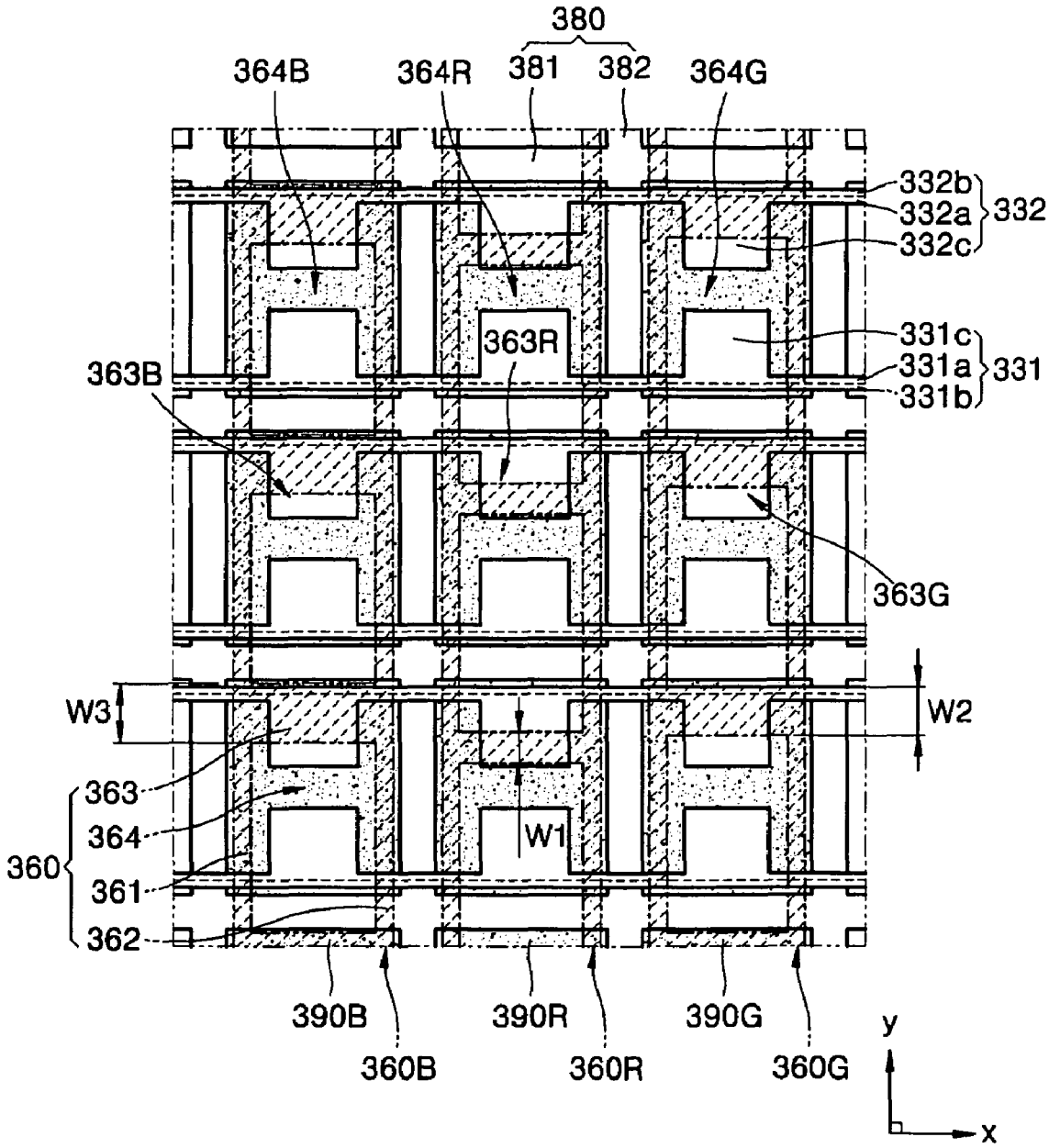
FIG. 4 is an enlarged view showing discharge electrodes of FIG. 3.

This will be described in more detail with reference to FIG. 4. Referring to FIG. 4, the red, green, and blue phosphor layers 390 include a red phosphor layer 390R, a green phosphor layer 390G, and a blue phosphor layer 390B. Further, the address electrodes 360 include a first address electrode 360R arranged in the red discharge cells, a second address electrode 360G arranged in the green discharge cells, and a third address electrode 360B arranged in the blue discharge cells.

Referring to FIG. 4, the barrier ribs 380 include the first barrier ribs 381 arranged along the X direction of the PDP 300 and the second barrier ribs 382 arranged along the Y direction of the PDP 300. The first and second barrier ribs 381 and 382 partition a discharge space into a matrix of discharge cells. Each discharge cell partitioned by the barrier ribs 380 includes the red, green, or blue phosphor layer 390R, 390G, or 390B.

The X and Y electrodes 331 and 332 are arranged facing each other in the discharge cells, and the first, second, and third address electrodes 360R, 360G, and 360B are arranged in a direction crossing the X and Y electrodes 331 and 332.

The X electrodes 331 traverse adjacent discharge cells arranged in the X direction of the PDP 300 and are arranged at a first side of the discharge cells. The Y electrodes 332 traverse adjacent discharge cells arranged in the X direction of the PDP 300 and are arranged at a second side of the discharge cells. The first side may be opposite to the second side, as shown in FIG. 4.

Each X electrode 331 includes a first protrusion 331*c* that protrudes from the first transparent electrode line 331*a* towards the Y electrode 332. For example, the first protrusion 331*c* may have a rectangular shape. Each Y electrode 332 includes a second protrusion 332*c* that protrudes from the second transparent electrode line 332*a* towards the X electrode 331. The second protrusion 332*c* may also have a rectangular shape. The first and second protrusions 331*c* and 332*c* have discharge gaps therebetween because they are arranged in predetermined intervals without contacting with each other.

Here, the first, second, and third address electrodes 360R, 360G, and 360B are arranged in a direction crossing the X and Y electrodes 331 and 332 in the discharge cells. One first, second, and third address electrode 360R, 360G, and 360B is arranged per line of discharge cells extending along the Y direction of the PDP 300.

Each first, second, and third address electrode 360R, 360G, and 360B includes a first address electrode line 361 arranged on one side of a unit discharge cell, for example, the left of the X direction, and a second address electrode line 362 arranged on the other side of the unit discharge cell, for example, the right of the X direction. Further, the first, second, and third address electrodes 360R, 360G, and 360B also include connection lines 363R, 363G, and 363B, respectively, which couple the first and second address electrode lines 361 and 362 to each other.

In other words, the stripe shaped first address line 361 traverses the discharge cells adjacent in the Y direction of the PDP 300. The stripe shaped second address line 362 also traverses the discharge cells adjacent in the Y direction of the PDP.

Additionally, the connection lines 363R, 363G, and 363B extend to the second address electrode line 362 from an inner wall of the first address electrode line 361 in each discharge cell. The connection lines 363R, 363G, and 363B are arranged to correspond to the second protrusions 332*c* of the Y electrode 332.

The width of the connection lines 363R, 363G, and 363B may be wide enough to form an aperture of the discharge cell, for example, the windows 364R, 364G, and 364B, between the first and second address electrode lines 361 and 362, not covering the entire unit discharge cell. Each window 364R, 364G, and 364B is formed between the connection lines 363 arranged in each discharge cell along the Y direction of the PDP 300.

Also, the windows 364R, 364G, and 364B are not linearly arranged along the Y direction of the PDP 300 inside the discharge space in which the red, green, and blue phosphor layers 390 are coated on the barrier ribs 380. In other words, the windows 364R, 364G, and 364B have a zigzag arrangement along the X direction.

The windows 364R, 364G, and 364B, which are areas in which portions of the discharge electrodes do not exist, may be formed by removing a portion of the first, second, and third address electrodes 360R, 360G, and 360B in the discharge cells, which reduces the entire area of the first, second, and third address electrodes 360R, 360G, and 360B, thereby lowering current consumption when applying the same voltage. The windows may also be formed by depositing address electrode material using a mask such that the windows are formed where address electrode material is not deposited.

As such, the first, second, and third address electrodes 360R, 360G, and 360B are shaped like a ladder along the Y direction of the PDP 300 by the first and second address electrode lines 361 and 362 and the connection lines 363R, 363G, and 363B coupled with the first and second address electrode lines 361 and 362.

The first, second, and third address electrodes 360R, 360G, and 360B of the red, green, blue discharge cells, respectively, have different sizes. That is, an address electrode 360 arranged in discharge cells coated with a phosphor layer 390 that has relatively unfavorable discharge characteristics is wider than an address electrode 360 arranged in discharges cell coated with a phosphor layer 390 that has relatively favorable discharge characteristics. Hence, the differently sized address electrodes compensate for the relatively unfavorable discharge characteristics of a phosphor layer. Here, the terms "relatively favorable" and "relatively unfavorable" describe a relationship among discharge characteristics of different colored phosphor layers. For example, in response to an identical electric field, a first phosphor layer, which has relatively unfavorable discharge characteristics as compared to a second phosphor layer, would emit less light than the second phosphor layer, which has relatively favorable discharge characteristics as compared to the first phosphor layer.

In other words, a width W2 of the connection line 363G of the second address electrode 360G arranged below the green phosphor layer 390G, which has relatively unfavorable discharge characteristics, and a width W3 of the connection line 363B of the third address electrode 360B arranged below the blue phosphor layer 390B, which has relatively unfavorable discharge characteristics, are wider than a width W1 of the connection line 363R of the first address electrode 360R arranged below the red phosphor layer 390R which has relatively favorable discharge characteristics as compared with the green phosphor layer 390G and the blue phosphor layer 390B.

Accordingly, as illustrated in the dotted lines, areas of the second and third address electrodes 360G and 360B corresponding to the protrusions 332*c* of the Y electrode 332 are relatively larger than an area of the first electrode 360R corresponding to the protrusion 332*c*.

The windows 364G and 364B formed in the discharge cells coated with the green and blue phosphor layers 390G and 390B are narrower than the window 364R formed in the discharge cells coated with the red phosphor layer 390R, unlike the connecting lines 363G and 363B, which are wider than the connecting lines 363R.

In this way, the discharge characteristics of the red, green, and blue phosphor layers 390R, 390G, and 390B may be adjusted to be substantially the same.

An operation of the PDP 300 is described below.

First, applying a predetermined voltage between the first, second, and third address electrodes 360R, 360G, and 360B and the Y electrodes 332 generates an address discharge, thereby selecting discharge cells to be emitted. Wall charges accumulate on inner walls of the selected discharge cells.

Here, the first, second, and third address electrodes 360R, 360G, and 360B respectively include the stripe-shaped first and second address electrode lines 361 and 362 per discharge cells, the connection lines 363R, 363G, and 363B coupling the first and second address electrode lines 361 and 362, and the windows 364R, 364G, and 364B, which are apertures, between the connection lines 363R, 363G, and 363B.

The first, second, and third address electrodes 360R, 360G, and 360B arranged in the red, green, and blue discharge cells form different sized windows 364R, 364G, and 364B, respectively.

As such, the areas of the connection lines 363R, 363G, and 363B corresponding to the Y electrodes 332 may be reduced so that electrical interference among the first, second, and third address electrodes 360R, 360G, and 360B may be minimized. Consequently, erroneous discharge may be prevented, and the discharge cells with unfavorable discharge characteristics may be compensated.

After wall charges are accumulated on inner walls of the selected discharge cells, a ground voltage is applied to the X electrodes 331 and a relatively higher voltage is applied to the Y electrodes 332. Thus, the voltage difference applied between the X and Y electrodes 331 and 332 causes the wall charges to move.

The wall charges travel and generate a discharge by colliding with discharge gas atoms inside the discharge cells, thereby generating plasma. The discharge starts between the X and Y electrodes 331 and 332, where a relatively strong electric field is formed, and expands outward.

When the voltage difference between the X and Y electrodes 331 and 332 falls below a discharge voltage, the discharge no longer occurs, and space charges and wall charges are formed in the discharge cells.

Here, if the polarity of the voltage applied to the X and Y electrodes 331 and 332 switches, discharge may occur again with the help of the wall charges. As such, by switching the polarity of the X and Y electrodes 331 and 332, the initial discharge process may be repeated. By repeating this process, discharge may be stably produced.

Here, the UV rays generated by the discharge excite phosphor materials of the red, green, and blue phosphor layers 390R, 390G, and 390B in the discharge cells. Through this process, visible rays are generated. The generated visible rays are emitted from the discharge cells to display an image.

As described above, a PDP according to exemplary embodiments of the present invention may have the following effects.

Since discharge electrodes with windows, which are apertures, are arranged in the PDP, areas of the discharge electrodes that are addressed are minimized to prevent erroneous discharge, and the PDP may be driven with a low current when addressing.

Also, the discharge characteristics of discharge cells coated with red, green, and blue phosphor layers may be adjusted to be substantially the same by forming areas of the discharge electrodes to be different for each of the differently colored discharge cells.

Further, by minimizing electrical interference among adjacent discharge electrodes, stable discharge characteristics may be obtained.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a first substrate;

a second substrate arranged substantially parallel to the first substrate;

barrier ribs arranged between the first substrate and the second substrate and defining discharge cells;

a phosphor layer arranged in the discharge cells;

first discharge electrodes arranged in the discharge cells, the first discharge electrodes comprising protrusions;

second discharge electrodes arranged in the discharge cells and in a direction crossing the first discharge electrodes to generate an address discharge with the first discharge electrodes; and third discharge electrodes arranged in the discharge cells, the third discharge electrodes being arranged parallel with the first discharge electrodes and comprising protrusions, wherein the second discharge electrodes comprise windows, the windows having different sizes for discharge cells having different color phosphor layers, and wherein the protrusions of the first discharge electrodes and the protrusions of the third discharge electrodes face each other in the discharge cells with a discharge gap therebetween, and the protrusions of the third discharge electrodes are arranged entirely within the windows.

2. The PDP of claim 1, wherein the windows are areas in which portions of the second discharge electrodes disposed along a first direction do not exist.

3. The PDP of claim 2, wherein a second discharge electrode comprises:

a first discharge electrode line and a second discharge electrode line traversing adjacent discharge cells; and a connection line coupling the first discharge electrode line and the second discharge electrode line, wherein the windows are apertures formed between adjacent connection lines.

4. The PDP of claim 3, wherein the connection line is arranged corresponding to a portion of the first discharge electrodes that is used to generate an address discharge.

5. The PDP of claim 3, wherein the second discharge electrode is arranged in a ladder pattern along the first direction.

6. The PDP of claim 3, wherein an area of a connection line arranged in a first discharge cell is larger than an area of a connection line arranged in a second discharged cell.

7. The PDP of claim 2, wherein the windows are non-linearly arranged along the first direction per discharge cells including red, green, and blue phosphor layers.

8. The PDP of claim 2, wherein an area of a second discharge electrode arranged in a first discharge cell is larger than an area of a second discharged electrode arranged in a second discharge cell.

9. The PDP of claim 2, wherein the windows formed in a second discharge electrode arranged in first discharge cells are smaller than the windows formed in a second discharge electrode arranged in second discharge cells.

* * * * *

UNITED STATES PATENT AND TRADEMARK OFFICE

CERTIFICATE OF CORRECTION

PATENT NO. : 7,638,944 B2
APPLICATION NO. : 11/251781
DATED : December 29, 2009
INVENTOR(S) : Jung-Suk Song It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 900 days.

Signed and Sealed this

Ninth Day of November, 2010

David J. Kappos

David J. Kappos
*Director of the United States Patent and Trademark Office*